United States Patent [19]

Burton

[11] Patent Number: 4,660,010

[45] Date of Patent: Apr. 21, 1987

[54] ROTARY LATCHING SOLENOID

[75] Inventor: James E. Burton, Vandalia, Ohio

[73] Assignee: Ledex, Inc., Vandalia, Ohio

[21] Appl. No.: 787,410

[22] Filed: Oct. 15, 1985

[51] Int. Cl.[4] ..... H01F 7/08

[52] U.S. Cl. ..... 335/228; 335/230; 335/234

[58] Field of Search ..... 335/228, 229, 230, 234, 335/272

[56] References Cited

U.S. PATENT DOCUMENTS

| | | | |
|---|---|---|---|
| 2,915,681 | 12/1959 | Troy | 317/123 |
| 3,229,171 | 1/1966 | Daugherty | 317/197 |
| 3,753,180 | 8/1973 | Sommer | 335/272 |
| 4,072,918 | 2/1978 | Read, Jr. | 335/236 |
| 4,093,931 | 6/1978 | Fenton | 335/272 |
| 4,135,138 | 1/1979 | McClintock | 335/272 |
| 4,151,499 | 4/1979 | Ganowsky et al. | 335/272 |
| 4,157,521 | 6/1979 | Leland | 335/228 |
| 4,419,643 | 12/1983 | Ojima et al. | 335/234 |
| 4,462,014 | 7/1984 | Montagu | 335/230 |

*Primary Examiner*—George Harris

*Attorney, Agent, or Firm*—Stevens, Davis, Miller & Mosher

[57] ABSTRACT

A rotary latching solenoid of the type in which a permanent magnet causes a flux flow path to be formed between opposing pole faces of an armature and a base in order to hold the armature in an energized or latched position is improved by providing the pole faces of the armature and base with raised sector portions, each sector portion having a sector face. In the energized or latched position, the sector faces of the armature and base are adjacent to each other and lines of flux flow between them are in a circumferential direction. The holding power of such an armature and base construction is greater than that of previous solenoids in which the opposing pole faces lie in a plane perpendicular to the solenoid axis. The solenoid is further improved by providing a ferromagnetic end cap between the permanent magnet and coil, and positioning the permanent magnet at an end opposite the rotary connection between the armature and the remainder of the solenoid, which in the preferred embodiment comprises complementary ball races. The end cap provides a flux flow path for both the energizing coil and permanent magnet, and the positioning of the permanent magnet reduces the magnetization of the ball race structure to maintain it free from contamination by magnetic particles. Embodiments are shown in which the cooperating sector faces are radial and axial, and in which the faces are offset from a radius and in which the faces are inclined to the axis.

14 Claims, 8 Drawing Figures

ROTARY LATCHING SOLENOID

BACKGROUND OF THE INVENTION

The present invention relates to magnetic solenoids and, more particularly, to rotary solenoids in which a permanent magnet is utilized to maintain the armature in an actuated, moved or latched configuration.

A typical rotary latching solenoid includes an electric energizing coil mounted within a housing or case, a base attached to the case and having a pole face, an armature which is rotatably mounted on the case and includes a hub extending through the case and a pole face facing the base pole face, a spring return for returning the armature to an unlatched position, and a latching mechanism which holds the armature in a latched or closed position against the return torque of the spring. In one such device, disclosed in U.S. Pat. No. 4,470,030 to Myers, the latching mechanism employs a permanent magnet which is mounted on the case opposite the base. When the coil of the solenoid is energized, a flux flow path extends about the coil and through the armature hub and base. The flux lines pass across the pole faces of the armature and base and draw the armature toward the base pole face.

The Myers' device includes an inclined ball race which converts the linear forces developed by the coil to rotary motion, thereby causing the armature to rotate relative to the base, and against a return spring, to an energized position. When in this position, the pole faces of the armature and hub and base are sufficiently close to allow the flux of the permanent magnet to flow between the armature and base when the coil is deenergized, thereby maintaining the armature in the energized position.

The armature is released to its deenergized position by pulsing the coil with the current in a reverse direction, thereby temporarily cancelling the magnet holding flux created and allowing the spring return to rotate the armature in the opposite direction to the initial rest position.

Although such rotary latching solenoids are compact and efficient, there are some disadvantages with their construction. For example, in the aforementioned Myers' device, the permanent magent is positioned immediately adjacent to the inclined ball race mechanism, so that the flux of the permanent magnet flows through the ball race mechanism. The magnetization of the ball races make them susceptible to accumulation of metal filings or other magnetic particles, which can result in fouling of the ball race mechanism.

Another disadvantage of such latching solenoids is that the pole faces of the armature and base are in a plane perpendicular to the axis of rotation of the solenoid. Since the inclined ball race mechanism is sloped at a relatively slight inclination, a relatively large radial rotation causes only relatively small displacement of the armature pole face away from the base pole face. Accordingly, the flux or holding force of the permanent magnet must be relatively strong in order to counteract this return movement of the armature, as caused by the inclined ball races.

Accordingly, there is a need for a latching solenoid in which the susceptibility of the ball races to contamination by magnetic particles is minimized. Furthermore, there is a need for a latching solenoid in which the armature and base design make a more efficient use of the flux from the permanent magnet when the armature is rotated to a latched position.

SUMMARY OF THE INVENTION

The present invention is a rotary latching solenoid in which the pole faces of the armature and base each include at least one cooperating section portion having sector faces which abut or are closely adjacent in the latched position. The respective sector faces are positioned so that, when the armature is rotated to the energized or latched position, the armature sector face is also rotated so that it is adjacent to and abuts the base sector face. When the armature is released to the deenergized position, preferably by a spring return, the sector face of the armature is displaced in a circumferential direction away from the sector face of the base.

The flux flow of a permanent magnet extends through the armature and base when the armature is in the energized position so that the flux flow is substantially perpendicular and through to the sector faces. Thus, the holding torque between the armature and base is greater than that of prior art solenoids since the forces holding the armature to the base are acting in the same direction as the forces exerted on the armature by the spring return, but in an opposite direction. As a result, a smaller or less powerful permanent magnet may be employed to achieve a latching torque greater than the magnitude suitable in prior art devices.

In a preferred embodiment of the invention, the solenoid includes an end cap made of ferromagnetic material which is positioned adjacent to the coil and is annular in shape to receive the armature sector. The base includes a disc-shaped flange and a central, cylindrically-shaped pole, and a permanent magnet is positioned between the base flange and the end cap. The magnet may be annular or made of an array of individual magnets arranged in a circular array. The ball race mechanism conventionally consists of complementary ball races formed in an armature plate and in an upper wall of the case remote from the permanent magnet. Accordingly, the flux flow through the ball race mechanism is minimized, thereby minimizing the tendency of the ball race mechanism to accumulate magnet contaminants.

The end cap is positioned to surround both sector portions of the armature and base. Since the end cap separates the coil from the permanent magnet, flux from both flows through the end cap and through the sectors of the armature and base, so that the end cap acts as a magnetic shunt between the magnet and coil. When the coil is pulsed with current in a reverse direction to release the armature from its latched position, the flux from the coil passes substantially through the end cap and does not pass through the permanent magnet, thereby avoiding the potentially deteriorating effects of such a flux on the permanent magnet.

The end cap is preferably provided with an annular inwardly directed taper which closes at a region adjacent the coil. The taper serves the purpose of diverting flux across a gap adjacent the coil, to improve the release or unlatching response when reverse polarity current is applied to the electric coil.

As previously noted, the holding force from the permanent magnet is primarily directed through respective sector sections or portions on the armature and on the base. One or more pairs of such cooperating sectors may be employed, depending in part upon the rotary stroke of the ball races. Further, while the abutting working surfaces, in the energized or latched position, may be radially flat or lie on a radius from the axis of rotation, it is within the scope of the invention to provide mutually offset and/or inclined surfaces, as the case may be, to have the effect of increasing the mutual surface area and thereby increasing the holding force.

Accordingly, it is an object of the present invention to provide a rotary latching solenoid which is compact and highly efficient; a latching solenoid in which the capability of the permanent magnet to hold the armature in the latched position is maximized, a latching solenoid in which the potential for following the ball race mechanism as a result of magnetization is minimized; and a latching solenoid in which the flux of the coil in the release mode through the permanent magnet is minimized.

Other objects and advantages of the invention will be apparent from the following description, the accompanying drawings and the appended claims.

DESCRIPTION OF PREFERRED EMBODIMENTS

Figure 1:
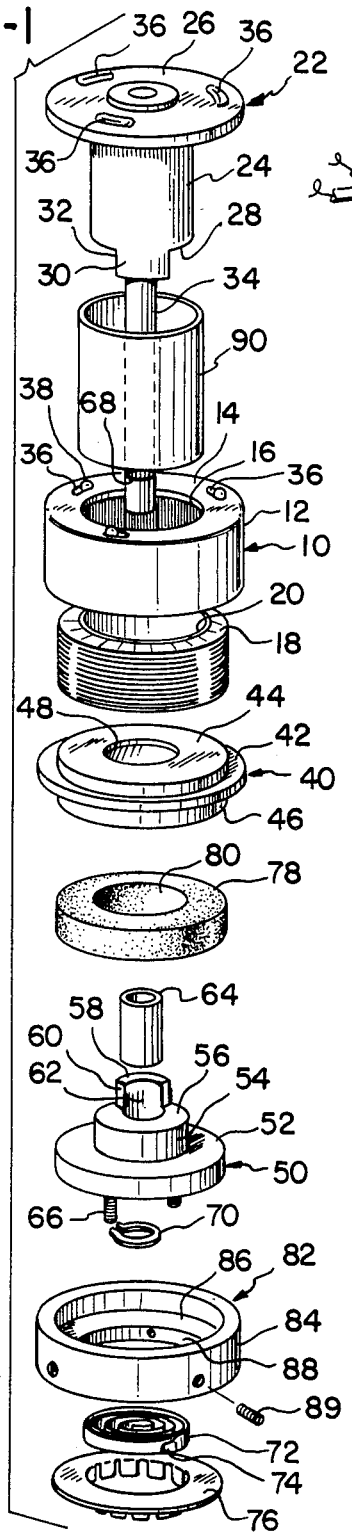
FIG. 1 is an exploded, perspective view of a rotary latching solenoid showing a preferred embodiment of the invention.
Figure 2:
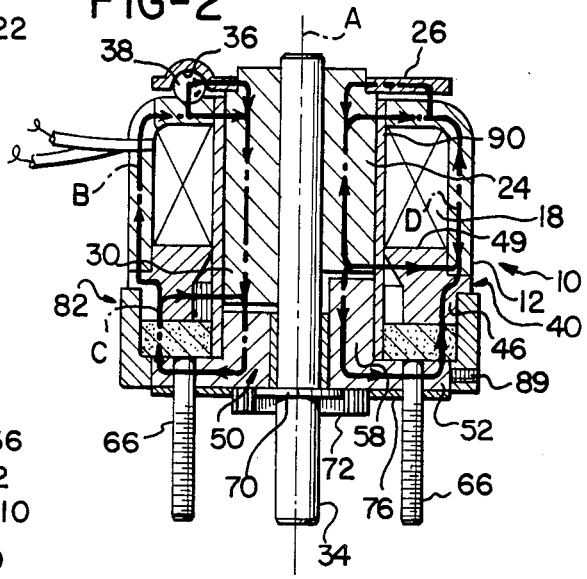
FIG. 2 is a side elevational view in section showing the solenoid of FIG. 1.

As shown in FIGS. 1 and 2, the rotary latching solenoid of the present invention includes a cup-shaped outer case 10 of ferromagnetic material having a generally cylindrical side wall 12, and an annular top wall 14 having an orifice 16 concentric with the side wall. An electric energizing coil 18 is positioned within the case 10 and is cylindrical in shape, having a central opening 20.

An armature 22 includes a cylindrical hub 24 extending from a disc-shaped plate 26. The hub 24 is sized to extend through the orifice 16 and opening 20, and includes an annular pole face 28 at its end. The pole face 28 includes at least one raised section portion 30 having a sector face 32 which extends generally radially from and lies in a plane generally parallel to a central axis A of the armature. The armature 22 also includes a shaft 34 which is coaxial with the central axis A and extends the length of the solenoid.

The plate 26 and top wall 14 of the case includes pairs of complementary ball races 36, each pair having a bearing ball 38 captured within it. The inclination of the ball races 36 causes the armature 22 to rotate in response to a force which would tend to draw the armature into the case 10. Consequently, such a force causes a slight longitudinal displacement of the armature 22 relative to the case 10 and a relatively large rotational movement of the armature with respect to the case.

An end cap 40, made of a ferromagnetic material, includes an outer flange 42, and upper annular portion 44, and a lower annular portion 46. The upper annular portion 44 is sized to form a friction fit within the case 10 to secure the coil 18 against the top wall 14, and the flange 42 is sized to form a smooth surface with the outer surface of the side wall 12. The end cap 40 includes a tapered central bore 48 which receives the sector portion 30 of the armature 22 therein. The tapered central bore 48, as shown in FIG. 2, is wider at the bottom than at the top, with the result that the flux tends to be concentrated along the narrow top portion 49 at the radial gap between this portion and the respective sector sections between the base and the armature hub.

The base 50 includes a base flange 52 and a raised central portion 54 which carries a cooperating radial pole face 56. The pole face 56 includes at least one raised sector 58 having a sector face 60 which also extends generally radially and in a plane generally parallel to the central axis A. The sector 58 is sized to extend upwardly into the central bore 48 of the end cap 40. The base 50 includes a central bore 62 which receives a bushing 64 in an interference fit. The bushing 64 acts as a bearing for the armature shaft 34, which is sufficiently long to protrude through the base flange 52. The base flange 52 also includes a pair of screw threaded studs 66 for mounting the solenoid on a piece of equipment (not shown).

Figure 3:
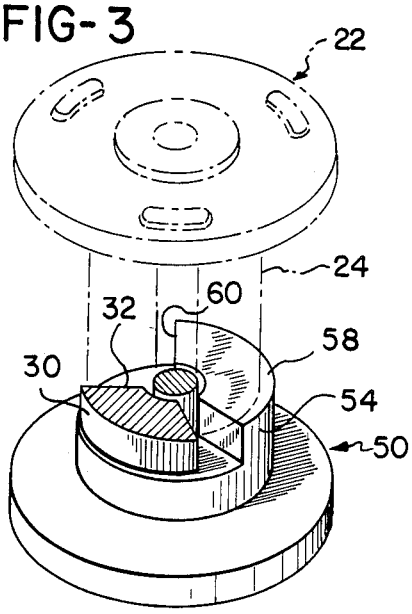
FIG. 3 is a perspective view of the engagement of the armature and base sectors of the solenoid of FIG. 1, in which the armature is shown substantially in phantom.
Figure 4:
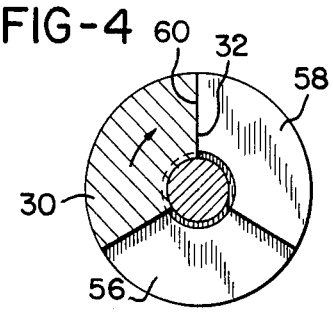
FIG. 4 is a plan detail of the solenoid of FIG. 1 showing the relative position of the sector portions of the armature and base when the armature is in the energized or latched position.
Figure 5:
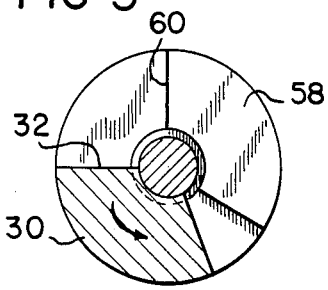
FIG. 5 is a plan detail of the solenoid as in FIG. 4 showing the sector portions of the armature and base when the armature is rotated to a deenergized position.

As shown in FIG. 3, the respective sectors of the base and armature are in relatively cooperating relation, but together occupy less than 360° so that there is provided room for the rotation of the armature sector 30 in the open space provided between the respective walls of the base sector 58. In the embodiment of the invention shown in FIG. 3, there is a single base sector 58 and a single cooperating armature sector 30 which, as shown in FIGS. 4 and 5, is movable between an actuated position in which the cooperating generally radially extending walls 32 and 60 are in substantially abutting relation (FIG. 4) to a deenergized or unactuated position as shown in FIG. 5 in which there is a substantial arcuate space between these walls. It should also be noted that two conventional axial air gaps 68 are formed between the generally radially extending and abutting faces 28 and 56 of the armature and the base in the unenergized position. These axial air gaps are working air gaps through and across which the axial closing force is created when the electric coil 18 is energized, thereby causing the armature body to be drawn toward the base and causing the rotation of the armature on the ball races in the conventional manner. This working stroke or operation of the rotary solenoid is not adversely affected by the fact that there have also been provided cooperating sector portions of the base and armature in which the armature sector rotates with respect to the base during such axial movement.

The armature shaft 34 includes a groove which receives a snap ring 70 to retain the armature within the case 10. The armature shaft 34 also includes a flat (not shown) adjacent to the groove, for receiving the inner end of a coil spring 72. The spring 72 includes a tang 74 that engages one of the teeth of a retainer disc 76 attached to the underside of the base flange 52.

An annular thickness oriented permanent magnet 78 is positioned on the base flange 52 and includes a central opening 80 through which extends the central portion 54 of the base 50. When the solenoid is assembled as shown in FIG. 2, the magnet 78 is sandwiched between the base flange 52 and the lower annular portion 46 of the end cap 40.

A spacer ring 82 of non-magnetic material includes a cylindrical side wall 84 shaped to receive the magnet 78 and lower annular portion 46, and a bottom wall having an opening 88 shaped to receive the base flange 52 of the base 50. The ring 82 forms a relatively close interference fit with the end cap 40. However, it forms a slight clearance fit with the flange of the base 50 so that the base 50 may be rotationally adjusted within the ring 82. The adjusted position is maintained by a series of three set screws 89 which extend through the wall of the ring 82 and into engagement with the flange 52. In this manner, the position of the base flange sector 58 may be accurately rotationally positioned with respect to the sector 30 of the armature 22, to the end that when the armature is in its fully energized position, which position is controlled by the balls 38 reaching the deep end of their respective races, the relatively abutting faces 60 and 32, as shown in FIG. 4, are just in physical contact with each other. In this manner, a minimum or zero air gap between the relative working rotational faces of the sectors may be initially set up and locked by tightening the set screws 89.

A non-magnetic sleeve 90 is preferably positioned through and within the orifice 16 of the case 10 and the central opening 20 of the coil 18 and may preferably extend axially inwardly through the central opening 80 of the magnet 78, terminating and resting on the base flange 52. The primary purpose of this non-magnetic sleeve, which may be formed of polymer or brass, is that of providing an auxilliary or supplementary bearing surface for the cylindrical portion 24 of the armature. It is shown in somewhat exaggerated thickness in the drawings and should be made as thin as practical so that the non-working magnetic gaps are held to a minimum.

As shown in FIGS. 3, 4 and 5, rotation of the armature 22 in a clockwise direction causes the sector face 32 of the armature hub 24 to rotate toward and be brought into close proximity to the sector face 60 of the base 50. Conversely, rotation of the armature 22 in a counterclockwise direction causes the sector face 32 to travel in a circumferential path away from the sector face 60 of the base 50. Although there is movement of the sector 30 in a direction along axis A (FIG. 2) the sector face 32 is directly opposed to and faces the sector face 60 when the armature 22 is rotated as shown in FIG. 5.

The operation of the latching solenoid is as follows: Upon energization of the coil 18, flux flows in a direction indicated by arrows B in FIG. 2. This flux path extends axially along the armature hub 24, through the upper portion of the base 54, through the end cap 40 and along the wall of the case 10. The flux exerts a force on the armature 22 which urges it downwardly toward the base 50. This force, which acts along axis A, is converted to rotary motion by the ball races 36 and balls 38 so that the hub 24 rotates in a clockwise direction as shown in FIG. 4, bringing sector face 32 of the armature into abutting relation with the face 60 of the base.

Upon the deenergization of the coil 18, the flux of the permanent magnet 78 comes into play. The flux generated by the permanent magnet 78 is shown in FIG. 2 by arrows C and extends through the end cap 40, armature sector 30, base sector 58 and base flange 52. Thus, the flux flows in a direction which is perpendicular to the planes containing the sector faces 32 and 60. The force exerted by the return spring 72 also acts in a circumferential direction which is perpendicular to the sector faces 32 and 60, but in an opposite direction. The armature is held in this energized or latched position by the flux of the permanent magnet 78.

In order to separate the sector faces 32 and 60, it is necessary to rotate the armature 22 in a counterclockwise direction, as shown in FIG. 5, which is substantially perpendicular to the flux flow path C. Therefore, the latching force exerted by the permanent magnet 78 is greater than that for prior art solenoids lacking the sector structure.

The solenoid is unlatched by applying a reverse current through the coil 18 to create the flux path indicated by arrows D in FIG. 2. This flux path also passes through the end cap 40 at the narrow section 49, base 50, hub 24 and case 10, but in a direction counter to that generated by the permanent magnet 78. The current supplied to the coil 18 is sufficient to create a flux D which is concentrated by the section 49 and equal or greater than the flux C created by the permanent magnet 78. This allows the return spring 72 to rotate the armature in a counterclockwise direction to the deenergized position.

The holding force of the permanent magnet 78 is efficiently utilized in retaining the rotary solenoid of this invention in the latched or moved position, by reason of the fact that the respective pole sectors are in abutting relation with a minimum of air gap therebetween, but as soon as the effective flux across this gap is cancelled and the armature begins to return to its unenergized position as shown by the arrow in FIG. 5, the gap rapidly widens and the effect of the permanent magnet is thereafter negligible. The cap 40, in addition to its function of providing a concentrated flux path for the electric coil when a reverse current is applied to cancel the holding force of the magnet, also acts as a conventional shunt which shields and protects the permanent magnet during normal solenoid operation.

It is within the scope of this invention to provide abutting faces 32 and 60 which are not precisely radial nor precisely axial. In fact, they may be mutually canted or inclined to a line parallel to the axis of rotation where it is desired to increase the respective abutting areas. Further, a plurality of interfitting sectors or poles may be provided to enhance holding power, particularly where a relatively short stroke is required.

Figure 6:
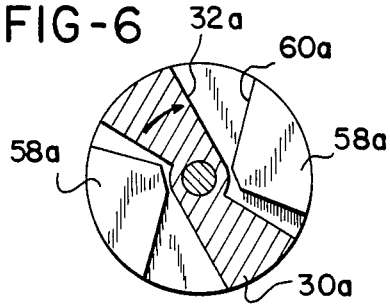
FIGS. 6 and 7 are plan views similar to FIG. 4 of modified forms of armature and base constructions.

FIG. 6 is an example in which a fan-shaped sector **30*a* is formed on the end of the armature 22 and movable in cooperation with a pair of opposed hub sectors 58*a*. Of course, it can readily be seen that any number of interfitting and cooperating sector portions 30 and 58 may be provided, in accordance with the rotational stroke involved. In the case of the embodiment of FIG. 6, it can also be seen that the generally abutting surfaces 32*a* and 60*a* which come into engagement in the energized position, are not truly radial but are laterally offset from a radius, with a resulting increase in respective surface areas. The parts in FIG. 6** are shown in the released or unenergized position.

Figure 7:
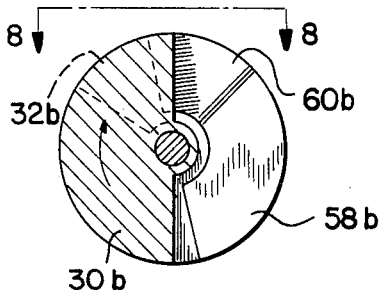
Figure 8:
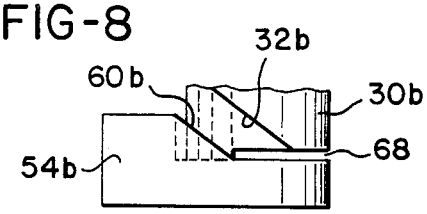
FIG. 8 is a fragmentary elevation looking along line 8—8 of FIG. 7.

FIGS. 7 and 8 show the embodiment of FIGS. 4 and 5 modified to provide mutually sloped, canted or inclined working faces **32*b* on the hub and 60*b*** on the base. In the energized or moved positions, the respective working or cooperating faces of the hub and base move together in an overlapping relation. The canting or inclining of such surfaces also provides increased areas which enhance the holding force provided by the flux of the permanent magnet. Such inclined faces may be provided in instances where a plurality of cooperating base and hub sector sections are employed.

It is also within the scope of this invention to use a series of magnet segments arranged in generally annular form, in lieu of a true ring magnet illustrated. In fact magnet segments which are thickness polarized may be preferred in some instances due to their availability or lower cost.

It is also within the scope of this invention to provide holding detents at the relatively deep end of the ball races. Such holding detents can be a coined shallow recess formed at the deep end of the rotary cam slots in the flange 26 or the wall 14 which assists the magnet in holding the solenoid in the actuated position, but which are not sufficiently deep as to prevent the return spring from readily rotating the parts back to the unenergized position, upon the pulsing or applying of a reverse current to the electric coil.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A rotary latching solenoid, comprising:

electric energizing coil means, a case receiving said coil means therein, armature means extending through said coil means and said case and being linearly movable relative thereto and rotatably movable relative thereto about a central longitudinal axis of said armature means, said armature means having a raised sector with a sector face extending from said axis, and a central shaft extending along and coaxial with said axis, base means receiving said shaft therethrough and positioned adjacent to said armature means, said base means having a raised sector with a cooperating sector face extending radially from said axis, means for rotating and axially displacing said armature means relative to said base means to a latched position when said coil means is energized, wherein said sector faces of said armature and said base are adjacent to and facing each other, and to an unlatched position, wherein said sector faces are rotationally spaced from each other, and permanent magnet means positioned to form a flux flow path across said sector faces when said armature means is in said latched position, whereby said armature means is held in said latched position.

2. The latching solenoid of claim 1 wherein said base means includes an annular, generally radially-extending first pole face, and said armature means includes an annular, generally radially-extending second pole face, said pole faces being adjacent and substantially parallel to each other when said armature means is held in said latched position.

3. The latching solenoid of claim 2 wherein said sectors of said base means and said armature means extends outwardly in an axial direction from said first and second pole faces respectively.

4. The latching solenoid of claim 1 further comprising an end cap made of ferromagnetic material and positioned between said coil means and said magnet means, whereby said end cap provides flux paths for both said coil means and said magnet means.

5. The latching solenoid of claim 4 wherein said end cap is annular in shape and is attached at an upper end thereof to said case.

6. The latching solenoid of claim 5 wherein said magnet means is annular and is positioned between said base means and said end cap.

7. A rotary latching solenoid comprising:

an electric energizing coil, a case receiving said coil therein, an armature extending through said coil and said case and being linearly movable relative thereto and rotatably movable relative thereto about a central, longitudinal axis of said armature, said armature having a central shaft extending along and being coaxial with said axis, said armature also having a sector-shaped portion on a working face thereof, end cap means made of a ferromagnetic material and positioned adjacent to said coil, said end cap means being substantially annular in shape and receiving said sector-shaped armature portion therein, base means coaxial with said armature and having a central, elevated portion, said portion having a complementary sector-shaped pole thereon, annular permanent magnet means positioned about said elevated base portion and said end cap, wherein said end cap means provides a flux flow path for a flux field of said coil and for a flux field of said magnet means, ball race means including complementary ball races formed in said armature and said case at an end of said solenoid opposite said magnet means, said ball races defining the limits of rotation of said armature in said case between an unenergized position in which said base and armature poles are separated and an energized position in which said base and armature poles are abutting, and spring return means for biasing said armature to an unlatched position.

8. In a rotary magnetic latching solenoid, including a case, coil means in said case, a based fixed to said case, an armature having a hub movable in said coil means and forming an axial air gap with said base, said armature being mounted on said case for rotary movement with respect thereto in response to energization of said coil means, the improvement comprising:

means on said armature hub and said base defining respective cooperating sector portions, each of said sector portions having a sector face, said sector faces forming a relatively closed air gap therebetween in a latched position of said hub corresponding to an energized position of said solenoid, and a permanent magnet in said solenoid adjacent to said base and forming a magnetic flux path in which a substantial portion of the flux from said magnet flows through said sector portions at said faces thereof for retaining said armature in said latched position following removal of energizing power from said coil, said sector portions also being in a magnetic flux path of said coil including said base and said case, whereby a reverse current to said coil substantially cancels the permanent magnet holding flux at said faces providing for the release of said armature from said moved position.

9. The latching solenoid of claim 8 in which said permanent magnet comprises a ring magnet positioned between said base and said coil.

10. The latching solenoid of claim 9 further comprising an annular magnetic shunt between said magnet and said coil.

11. The latching solenoid of claim 10 in which said shunt is formed with a narrow annular flux concentrating portion formed in surrounding relation to said sector portions.

12. The latching solenoid of claim 8 in which said sector portion faces are offset from a radius line through said hub and base.

13. The latching solenoid of claim 8 in which said sector portion faces are mutually inclined to a line parallel to the axis of rotation of said armature.

14. The latching solenoid of claim 8 further comprising means on said hub and base forming a plurality of said sector portions with the base sector portions being interfitted arcuately between the hub sector portions.

* * * * *